US007509077B2

(12) United States Patent
Schulze-Hagenest et al.

(10) Patent No.: US 7,509,077 B2
(45) Date of Patent: Mar. 24, 2009

(54) METHOD AND PRINTING MACHINE USED FOR PRINTING WITH THE USE OF TONER

(75) Inventors: Detlef Schulze-Hagenest, Molfsee (DE); Udo Draeger, Speyer (DE); Domingo Rohde, Kiel (DE)

(73) Assignee: Eastman Kodak Company, Rochester, NY (US)

( * ) Notice: Subject to any disclaimer, the term of this patent is extended or adjusted under 35 U.S.C. 154(b) by 128 days.

(21) Appl. No.: 11/564,871

(22) Filed: Nov. 30, 2006

(65) Prior Publication Data

US 2007/0122197 A1 May 31, 2007

(30) Foreign Application Priority Data

Nov. 30, 2005 (DE) ..... 10 2005 057 471

(51) Int. Cl.
*G03G 15/01* (2006.01)

(52) U.S. Cl. ..... 399/223; 399/298

(58) Field of Classification Search ..... 399/223, 399/299, 302, 82, 298, 1, 2, 112, 341; 347/156
See application file for complete search history.

(56) References Cited

U.S. PATENT DOCUMENTS

| | | | | |
|---|---|---|---|---|
| 5,160,969 | A | 11/1992 | Mizuma et al. | 399/223 |
| 5,370,961 | A | 12/1994 | Zaretsky et al. | 430/125.32 |
| 5,790,915 | A * | 8/1998 | Arcaro et al. | 399/2 |
| 5,968,656 | A | 10/1999 | Ezenyilimba et al. | 430/423.1 |
| 6,163,672 | A | 12/2000 | Parker et al. | 399/223 |
| 6,188,861 | B1 | 2/2001 | Parker et al. | 399/299 |
| 7,274,900 | B2 * | 9/2007 | Shimmura | 399/298 |
| 2003/0129006 | A1 * | 7/2003 | Hoshi et al. | 399/298 |

FOREIGN PATENT DOCUMENTS

| | | | |
|---|---|---|---|
| EP | 1 155 844 | A2 | 11/2001 |
| JP | 04-226482 | A * | 8/1992 |
| JP | 09-015925 | A * | 1/1997 |
| JP | 09-146333 | A * | 6/1997 |

OTHER PUBLICATIONS

Translation of JP 09-015925 A dated Jun. 12, 2008.*
Translation of JP 09-146333 A dated Jun. 12, 2008.*

* cited by examiner

*Primary Examiner*—Sophia S Chen

(57) ABSTRACT

Printing with the use of toner, in particular, for electrophotographic printing, wherein a printing machine set up for multicolor printing and includes several imaging stations or printing units is provided with at least two black toners in two imaging stations or printing units, one of said toners being suitable and provided for generating a duller printed image and one being suitable and provided for generating a glossier printed image, the printing of the duller printed image being at one speed and the printing of the glossier printed image being at a different speed.

17 Claims, 3 Drawing Sheets

METHOD AND PRINTING MACHINE USED FOR PRINTING WITH THE USE OF TONER

FIELD OF THE INVENTION

The invention relates to printing with the use of toner, in particular, for electrophotographic printing.

BACKGROUND OF THE INVENTION

EP 1 155 844 A2 has disclosed one basic idea of precisely registered printing of partial color images or color separations in multi-color printing of toner images with the use of an electrophotographic printing machine. In such a printing machine, the printing material passes through successive imaging stations or printing units that are supplied with a toner of a specific color, and the color separations of this color are transferred to the printing material. For color printing, two or more printing units may be used to achieve this; whereas, for black-and-white printing, one such printing unit is sufficient. For multi-color printing, in most cases four printing units are used, these being provided for the colors cyan, magenta, yellow, and black (briefly also referred to as CMYK).

It should be explained that, referring to electrophotographic printing machines, the concepts "imaging station" and "printing unit" are frequently used synonymously, whereby the description of the "printing unit" has mainly been adopted from the field of offset printing. In more specific terms, an imaging station in electrophotographic printing is a zone in the machine, in which the image support, which is to be charged with the desired image pattern, is provided with an image and developed with toner. This developed image is then transferred directly or indirectly to the printing material; at this point, this could already be referred to as "printing", even though the completion of printing might still take into account a simultaneous or later fusing of the finished printed image to the printing material. Within that meaning, an imaging station mostly corresponds to a printing unit or a part thereof.

Obviously, a printing machine for multi-color printing could also be used for black-and-white printing. Such a use would be particularly desirable, for example, if a print job for printing a brochure required printing of multi-color picture pages as well as black-and-white text pages, in order to be able to print this brochure in a continuous and sorted manner. Until now, this has been uneconomical because a conventional color-printing machine operates more slowly and more expensively compared with a black-and-white printing machine.

In addition, there is the fact that the toner used in a color-printing machine usually is different from that used in a black-and-white printing machine because the two toners must perform different functions. The black toner in the printing machine is required within the framework of color management and color space transformation in order to implement the color space in which the color-printing machine generates its color-printed images, whereas the black toner in the black-and-white printing machine is to generate exclusively black with the best possible saturation, mostly for printing letters. Additionally, the color print is to be mostly glossy and as brilliant as possible, whereas the letters should be dull and matt for better readability and for greater light absorption.

SUMMARY OF THE INVENTION

The purpose of the invention is to improve a method and a printing machine of the aforementioned type in that, with the use of a printing machine for multi-color printing, selectively also a black-and-white print can be adequately produced. In conjunction with this, the term "adequate" may relate in particular to the printed image and/or be due to economical reasons.

In accordance with the invention, referring to the method, this purpose is achieved in that a printing machine set up for multi-color printing and comprising several imaging stations or printing units is provided with at least two black toners in two imaging stations or printing units, one of said toners being suitable and provided for generating a duller printed image and one being suitable and provided for generating a glossier printed image.

In this manner, in accordance with the invention, advantageously, color printing or black-and-white printing may take place selectively on one and the same printing machine and, regarding both situations, the desirable printed image appearance and quality can be achieved.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
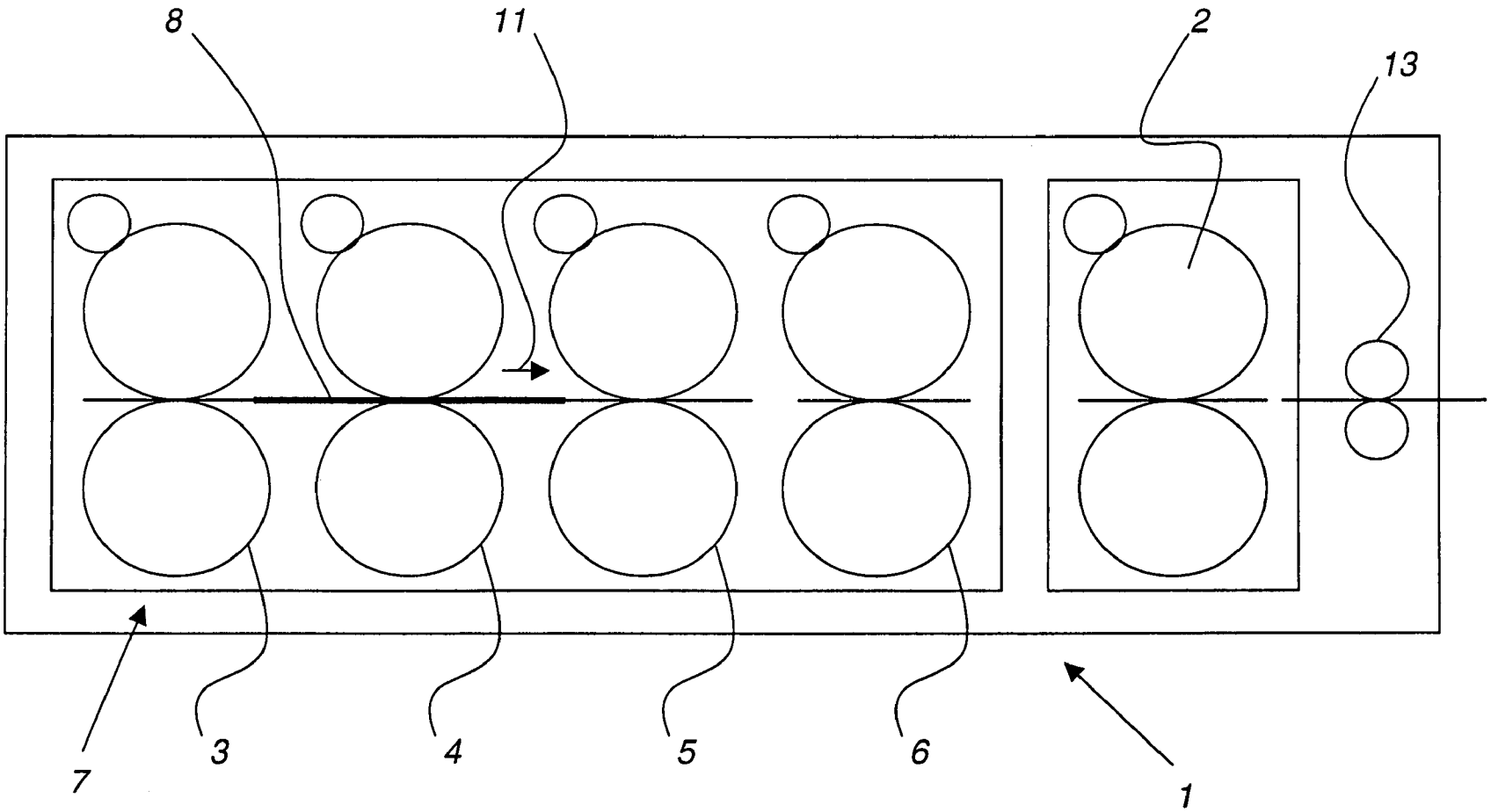
FIG. 1 shows a schematic representation of a printing machine that incorporates an additional printing unit.

Preferably, in accordance with the invention, a standard, as it were, printing machine is set up in such a manner that up to five printing units are made available for printing in the printing machine, four of said printing units being designed for conventional four-color printing and being supplied with cyan, magenta, yellow, and black printing inks; whereby this black toner is the toner used for generating a glossier printed image, and the additional, preferably fifth, printing unit is supplied with the black toner for generating the duller printed image.

Consequently, preferably a color-printing machine is set up in such a manner that it is supplemented by a fifth printing unit and thus is provided with the additional feature of being able to produce a conventional black-and-white print, without restricting or impairing the usual color print in any way.

In order to be able to take into account the viewpoint of economics regarding both types of prints, preferably a selection between two operating speeds is possible. The higher operating speed is preferably approximately twice as high as the slower operating speed, however, this speed may optionally also be higher than twice as high.

In accordance with the invention, the higher speed may be elegantly achieved in that, at the lower operating speed, each operated printing unit performs approximately 100% of toner coverage of its color separation and, at the higher operating speed, each operated printing unit performs only approximately 50% of toner coverage.

In addition, it may preferably be provided that each printing unit can be individually added to the operating process or removed from the operating process, and that this addition or removal is adjusted to the particular print job. Basically, this addition or removal can be performed mechanically, for example, by moving the printing unit concerned back and forth or by changing the path of the printing material.

In order to achieve a print adequate for the particular job, the aforementioned measures can be utilized in that, for a conventional four-color print, conventional printing units, including the printing unit with the glossy black toner, are used to produce a glossy color print at the slower operating speed, and/or, for a black-and-white print, the two black toners are used together, in that said printing units are used to, in turn, print the same color separation in a registered superimposed manner. This latter option is particularly elegant because, as a result, the two printing units share the work in a simple manner and thus twice the speed can be achieved and, at the same time, the duller toner being the second black toner, defines the appearance of the printed image. The reason for this is that, surprisingly, it has been found that the same toner coverage is not at all required with the matt toner. At this point, it should be additionally mentioned that, if desired, the option of using a transparent toner for certain requirements could be set up and provided.

Also, in accordance with the invention, two-color printing is preferably possible in that the two black toners are used together for a two-color print in that, by using them in turn, the same color separation is printed in a registered superimposed manner and in that at least one of the other printing units having a colored toner is used for printing the second color.

In order to print the second color, a printing unit may be supplied with a toner of the appropriate color. If necessary, a custom color, or the up to three colored toners, can be used to produce the desired color in the color space. However, for example, for a two-color print, the glossy black toner could also be used; and the matt-black toner in its printing unit could be replaced by toner of the desired second color as the custom color.

Independent protection is claimed for an inventive printing machine for printing with the use of toner, in particular an electrophotographic printing machine, in particular for carrying out the inventive method, said printing machine being characterized in that, for a print, up to five printing units are provided in the printing machine, and in that each printing unit can be individually added to the operating process or removed from the operating process.

As already mentioned in conjunction with the inventive method, two operating speeds may be selected, in which case the higher operating speed is preferably twice as high as the slower operating speed.

Referring now to the accompanying drawing, FIG. 1 shows a schematic representation of a printing machine 1 that incorporates a printing unit 2 for applying a black toner that generates a duller printing image on the substrate 8 after being fused in fuser station 13 of the printer. The printing machine incorporates four additional printing units 3 through 6. These printing units 3 through 6 are shown collectively in FIG. 1, in a printing mechanism 7. The printing units 3 through 6 on one hand and printing unit 2 on the other hand, are shown in different frames within the printing mechanism 7, but may be assembled on one frame for all five or in individual frames for each printing unit as well. In this printing mechanism 7, toner images in the CMYK colors are applied to a substrate 8, which is e.g. paper, board, and plastic or film material.

In the printing machine 1, the substrate 8, as is shown in FIG. 1, is conveyed along a travel path in the direction of the arrow 11. The substrate 8 sequentially passes through the printing mechanism 7, passing along printing units 3, 4, 5, and 6, the printing unit 2, and a fuser mechanism 13, in which the glossy toner images in the CMYK colors applied to the substrate in printing units 3 through 6 and the dull black toner image formed by the second black toner and applied to the substrate in printing unit 2 are fused onto the substrate material 8.

In the printing machine 1 shown, the individual printing units 2 through 6 are applying the image directly to the substrate. Alternatively, the images may be applied via an intermediate transfer drum like described in U.S. Pat. No. 5,968,656, in the names of Ezenyilimba et al., herein incorporated by reference, assigned to each printing unit or the images may be overlaid on a common transfer means and jointly transferred to the substrate as described in U.S. Pat. No. 5,370,961, in the names of Zaretsky et al., herein incorporated by reference.

The toner images can be fused through the application of heat and pressure, but also through pressure alone or any contact-free method, for example, through continuous or discontinuous irradiation fusing, such as fusing with continuous IR or UV-light, flash fusing, or through passage through a microwave fuser mechanism.

Figure 2:
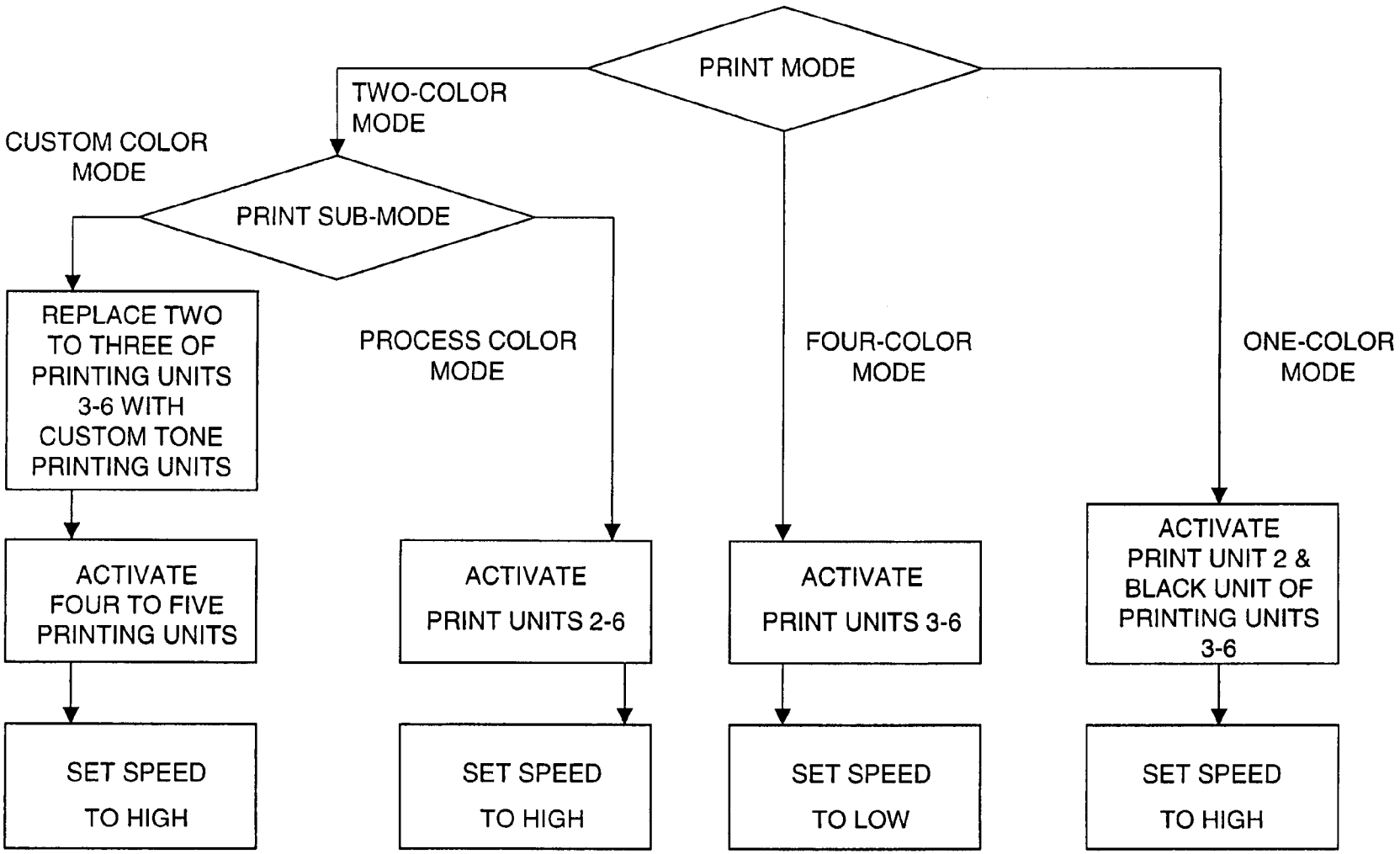
FIG. 2 shows a flowchart of the printing method of this invention.

FIG. 2 shows a flowchart of different modes in which the printing machine of FIG. 1 can be run. These examples are, of course, not limiting the invention. Three basic print modes are described: one-color printing, two-color printing and four-color printing. The two-color mode is again separated in two sub-modes using custom color or process color printing.

Figure 3:
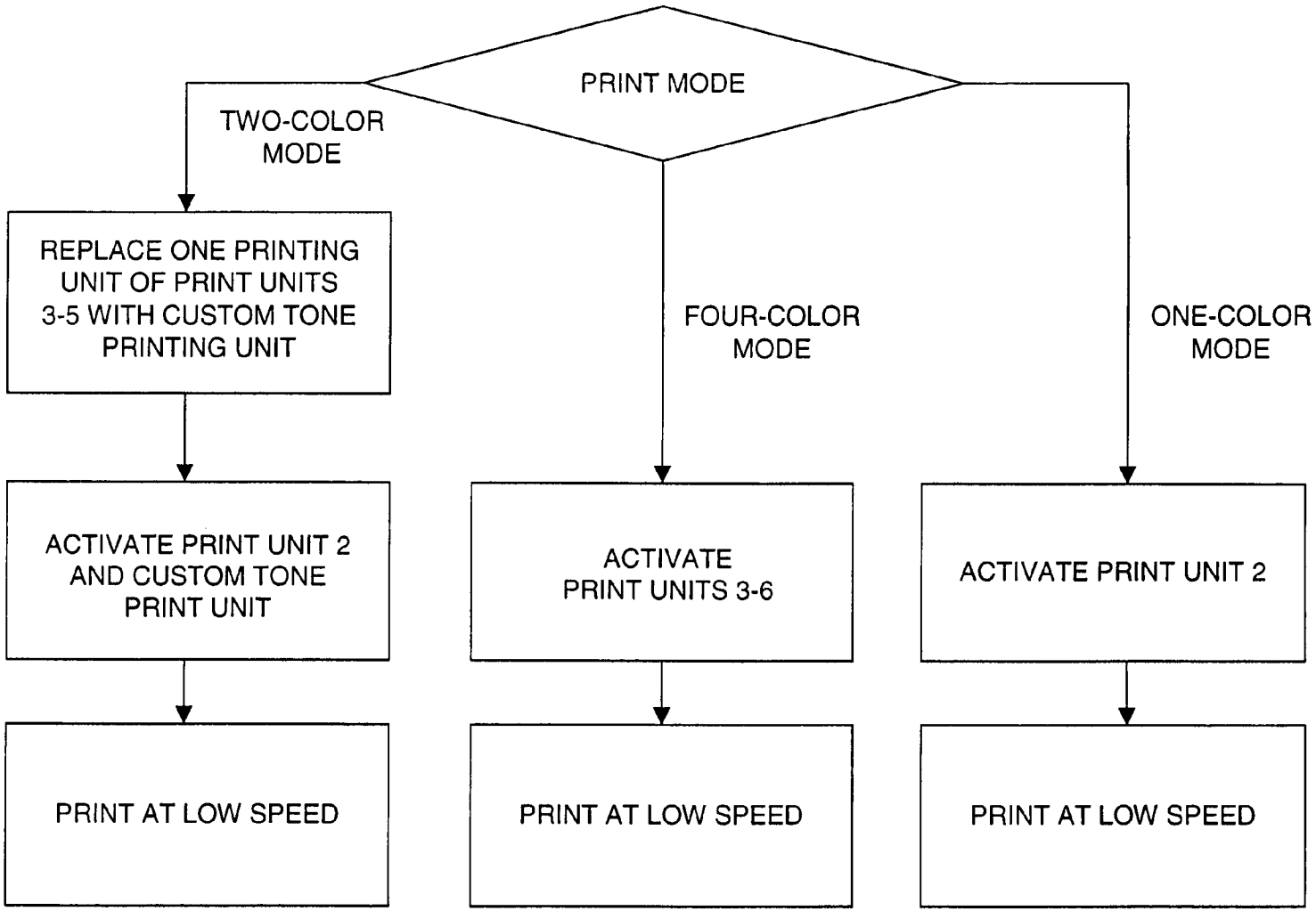
FIG. 3 (PRIOR ART)
FIG. 3 shows a flowchart of the prior art printing method.

FIG. 3 shows a flowchart of a different mode in which a printing machine of FIG. 1 can be run according to prior art. Three basic print modes are described: one-color printing, two-color printing and four-color printing.

According to this invention the printing machine 1 can be used in several modes.

In a first mode for four-color printing (FIG. 2, four-color mode column) the printing units (FIG. 1) 3, 4, 5, and 6 are used. They are printing the cyan, magenta, yellow, and black image in sequence into the substrate 8. The second black printing unit 2 is not used in this mode and may be either passive only or even lifted up from the substrate path. The individual printing units are printing up to a full layer (100%) of toner onto the substrate depending on the individual image data. The total quantity of toner is up to 400% or less if under color removal is used, where the achromatic portion composed from cyan, magenta, and yellow is replaced by the corresponding black portion. In this mode, the printer runs in a first lower speed, e.g., 30 cm/s and the image shows high gloss of, e.g. 35 measured at an angle of 60°.

In a second mode for one-color printing (FIG. 2, one-color mode column) one of the printing units (FIG. 1) 3, 4, 5, and 6, which is equipped with black toner for generating a glossier printed image is used as well as the additional fifth printing unit 2 supplied with the toner for generating the duller print image. The other printing units for printing a cyan, magenta, or yellow color image are not used in this mode and may be either passive only or even lifted up from the substrate path. In this mode the image of both black-printing units are the same and printed overlaid so that the toner for generating the duller print image is on top resulting in a matt-black image after fusing. In this mode the printer runs in a second higher speed, e.g., 60 cm/s and the image shows low gloss of, e.g., 5 measured at an angle of 60°. The print units are printing the same quantity of toner per time as in the first mode described above, which results that each operating printing unit performs only approximately 50% of toner coverage.

In a third mode for two-color printing (FIG. 2, two-color mode column, process color sub-mode) all of the printing units (FIG. 1) 2, 3, 4, 5, and 6 are used. In this mode the image of the cyan, magenta, and yellow printing unit are overlaid to print a custom color and the both black printing units are overlaid as well. In this mode the printer runs in a second higher speed, e.g., 60 cm/s. The print units are printing the same quantity of toner per time, which results that each operating printing unit performs only up to approximately 50% of toner coverage. But overlaying the images allows receiving a mixed color of full density in wide range of the color gamut and a black image of full density. Depending on the requirements the fifth printing unit 5 can be equipped with glossy or dull black toner.

In a fourth mode for two-color printing (FIG. 2, two-color mode column, customer color sub-mode) 4 to 5 of the printing units (FIG. 1) 2, 3, 4, 5, and 6 are used. In this mode, besides the two printing units printing black toner in an overlaid manner as described above (printing unit 2 and one of the printing units 3 through 6), two or three printing units are replaced by printing units printing all the same custom color and the images are overlaid as well. A suitable custom toner is described in U.S. Publication No. 2005-0221278 A1, in the names of Iwatani et al., herein incorporated by reference. In case that one of the printing units 2 through 6 is not used in this mode, it may be either passive only or even lifted up from the substrate path. In this mode the printer runs in a second higher speed, e.g., 60 cm/s. The print units are printing the same quantity of toner per time as in mode 1, which results that each operating printing unit performs only up to approximately 50% of toner coverage. But overlaying the images allows receiving customer color and black images of full density. Depending on the requirements the printing units can be equipped with glossy or dull toner. Comparative example according prior art:

In the one-color printing mode (FIG. 3, one-color mode column) the black printing unit 2 (FIG. 1), (alternatively one of the printing units 3 through 6, which is equipped with black toner), is used alone. All other print units are passive.

In the two-color mode (FIG. 3, two-color mode column) the black printing unit 2 (FIG. 1), (alternatively one of the printing units 3 through 6, which is equipped with black toner), is used together with one of the printing units 3 through 6, which is repaced to a customer tone print unit. All other print units are passive.

In the four-color mode (FIG. 3, four-color mode column), the printing units 3 through 6 are used.

Printing unit 2 is passive.

In all cases the individual printing units are printing up to a full layer (100%) of toner onto the substrate depending on the individual image data. In this mode the printer runs in a first lower speed, e.g., 30 cm/s.

The invention has been described in detail with particular reference to certain preferred embodiments thereof, but it will be understood that variations and modifications can be effected within the spirit and scope of the invention.

PARTS LIST

1 Printing Machine
2 Printing Unit
3 Printing Unit
4 Printing Unit
5 Printing Unit
6 Printing Unit
7 Printing Mechanism
8 Substrate
11 Travel Path
13 Fuser Station

What is claimed is:

1. Method of printing with the use of toner, in particular for electrophotographic printing, characterized in that, a printing machine set up for multi-color printing and comprising several imaging stations is provided with at least two black toners in two imaging stations, one of said toners being suitable and provided for generating at one operating speed a duller printed image and one being suitable and provided for generating at a different operating speed a glossier printed image wherein at a lower operating speed, each operated printing unit performs approximately 100% of toner coverage of its color separation and, at a higher operating speed, each operated printing unit performs only approximately 50% of toner coverage.

2. Method as in claim 1, characterized in that, up to five printing units are made available for printing in the printing machine, four of said printing units being designed for conventional four-color printing and being supplied wit cyan, magenta, yellow, and black printing inks, whereby this black toner is the toner used for generating a glossier printed image, and the additional, preferably fifth, printing unit is supplied with the black toner for generating the duller printed image.

3. Method as in claim 2, characterized in that, each printing unit can be individually added to an operating process or removed from the operating process, and that this addition or removal is adjusted to a particular print job.

4. Method as in claim 2, characterized in that, for a conventional four-color print, conventional printing units, including the printing unit with a glossy black toner, are used to produce a glossy color print at the lower operating speed.

5. Method as in claim 2, characterized in that, the two black toners are used together for a two-color print in that, using them in turn, the same color separation is printed in a registered superimposed manner and in that at least one of the other printing units having a colored toner is used for printing a second color.

6. Method as in claim 5, characterized in that, in order to print a second color, a printing unit may be supplied with a toner of a appropriate color, if necessary, a custom color, or the up to three colored toners can be used to produce a desired color in a color space.

7. Method as in claim 2, characterized in that, for a two-color print, a glossy-black toner is used and a matt-black toner in its printing unit is replaced by toner of a desired second color as a custom color.

8. Method as in claim 1, characterized in that, one operating speed is approximately twice as high as the different operating speed.

9. Method as in claim 1, characterized in that, for a black-and-white print, the two black toners are used together, in that, using them in turn, the same color separation is printed in a registered superimposed manner.

10. Method of printing with the use of toner, in particular for electrophotographic printing, characterized in that, a printing machine set up for multi-color printing and comprising several imaging stations is provided with at least two black toners in two imaging stations, one of said toners being suitable and provided for generating at one operating speed a duller printed image and one being suitable and provided for generating at a different operating speed a glossier printed image, further characterized in that up to five printing units are made available for printing in the printing machine, four of said printing units being designed for conventional four-color printing and being supplied with cyan, magenta, yellow, and black printing inks, whereby this black toner is the toner used for generating a glossier printed image, and the additional, preferably fifth, printing unit is supplied with the black toner for generating the duller printed image, one operating speed is approximately twice as high as the different operating speed, and at the lower operating speed, each operated printing unit performs approximately 100% of toner coverage of its color separation and, at the higher operating speed, each operated printing unit performs only approximately 50% of toner coverage.

11. Method as in claim 10, characterized in that, for a conventional four-color print, conventional printing units, including the printing unit with a glossy black toner, are used to produce a glossy color print at the lower operating speed.

12. Method as in claim 10, characterized in that, for a black-and-white print, the two black toners are used together, in that, using them in turn, the same color separation is printed in a registered superimposed manner.

13. Method as in claim 10, characterized in that, the two black toners are used together for a two-color print in that, using them in turn, the same color separation is printed in a registered superimposed manner and in that at least one of the other printing units having a colored toner is used for printing a second color.

14. Method as in claim 13, characterized in that, in order to print the second color, a printing unit may be supplied with a toner of an appropriate color, if necessary, a custom color, or the up to three colored toners can be used to produce a desired color in a color space.

15. Method as in claim 10, characterized in that, for a two-color print, a glossy-black toner is used and a matt-black toner in its printing unit is replaced by toner of a desired second color as a custom color.

16. Method as in claim 10, characterized in that, each printing unit can be individually added to an operating process or removed from the operating process, and that this addition or removal is adjusted to a particular print job.

17. Printing machine used for printing with the use of toner, preferably an electrophotographic printing machine, characterized in that, for a print, up to five printing units are provided in the printing machine, and in that each printing unit can be individually added to the operating process or removed from the operating process, wherein the operating speeds for the printing units can be selected, and a higher operating speed is approximately twice as high as a lower operating speed, and, wherein at a lower operating speed, each operated printing unit performs approximately 100% of toner coverage of its color separation and, at a higher operating speed, each operated printing unit performs only approximately 50% of toner coverage.

* * * * *